US006738453B2

(12) United States Patent
Taguchi et al.

(10) Patent No.: US 6,738,453 B2
(45) Date of Patent: May 18, 2004

(54) HOT CATHODE OF X-RAY TUBE

(75) Inventors: Takeyoshi Taguchi, Tachikawa (JP); Katsumi Tsukamoto, Tokyo (JP); Masaru Kuribayashi, Akishima (JP)

(73) Assignee: Rigaku Corporation, Tokyo (JP)

( * ) Notice: Subject to any disclaimer, the term of this patent is extended or adjusted under 35 U.S.C. 154(b) by 37 days.

(21) Appl. No.: 10/245,660

(22) Filed: Sep. 17, 2002

(65) Prior Publication Data

US 2003/0053595 A1 Mar. 20, 2003

(30) Foreign Application Priority Data

Sep. 19, 2001 (JP) ..... 2001-284581

(51) Int. Cl.[7] ..... H01J 35/06
(52) U.S. Cl. ..... 378/136; 378/134
(58) Field of Search ..... 378/136, 134

(56) References Cited

U.S. PATENT DOCUMENTS 4,344,011 A 8/1982 Hayashi et al.
5,142,652 A * 8/1992 Reichenberger et al. .... 378/136
5,703,924 A * 12/1997 Hell et al. ..... 378/136
6,115,453 A * 9/2000 Hell et al. ..... 378/136
2002/0009179 A1 1/2002 Hess et al.

FOREIGN PATENT DOCUMENTS

JP 10-321119 A 12/1998
JP 2001-84932 A 3/2001

* cited by examiner

*Primary Examiner*—Craig E. Church
*Assistant Examiner*—Jurie Yun
(74) *Attorney, Agent, or Firm*—Frishauf, Holtz, Goodman & Chick, P.C.

(57) ABSTRACT

In a hot cathode of an X-ray tube of the kind having a thermoelectronic emitter supported by a heating element, the emitter is comprised of plural emitter regions separated from each other. Each emitter region has the largest measure less than 3 mm, so that no crack occurs on the thermoelectronic emitter. The hot cathode is comprised of a heating element made of glassy carbon and a thermoelectronic emitter supported by the heating element. The emitter is comprised of plural emitter regions made of sintered lanthanum hexaboride. The hot cathode can be produced as described below. The heating element with a thickness of 1 mm is formed, at its thermoelectron-emitting side, with four recesses each of which is 2.6 mm in length, 0.5 mm in width and 0.3 mm in depth. The recesses are filled with lanthanum hexaboride powder, which is then sintered to complete four emitter regions.

11 Claims, 4 Drawing Sheets

HOT CATHODE OF X-RAY TUBE

BACKGROUND OF THE INVENTION

This invention relates to a hot cathode of an X-ray tube and more particularly to a hot cathode of the kind having a thermoelectronic emitter supported by a heating element.

It is known to use lanthanum hexaboride ($LaB_6$) as the material of a thermoelectronic emitter of a hot cathode of an X-ray tube. The lanthanum hexaboride may constitute a hot cathode as it is as disclosed in FIGS. 1 and 14 of Japanese Patent Publication 10-321119 A (1998) or may be supported by a heating element made of carbon or the like to complete a hot cathode as disclosed in FIGS. 9 and 10 of the same Japanese Patent Publication 10-321119 A (1998). The present invention is directed to the latter case, i.e., a thermoelectronic emitter is supported by a heating element.

The hot cathode of the kind having a thermoelectronic emitter, which is made of lanthanum hexaboride and supported by a heating element made of carbon, can be produced by the steps of making grooves on the heating element, filling the grooves with lanthanum hexaboride powder and sintering the powder as disclosed in Japanese Patent Publication 2001-84932 A.

However, in case of producing a narrow thermoelectronic emitter, for example, 10 mm×0.5 mm, by sintering lanthanum hexaboride powder as mentioned above, it has been reported that a certain problem occurred. The report said that when the sintered hot cathode had been used for a long time to generate X-rays in an X-ray tube, the filament current of the X-ray tube, i.e., the current flowing from one end of the hot cathode toward the other end, showed a large hunting phenomenon and thus the current was uncontrollable. The filament current is normally controlled to become, for example, 1.2 A±0.5 A. If the uncontrollable phenomenon occurs, the current departs from the normal range far away and can not be restored, so that the control circuit is terminated and the X-ray generation stops and thus the X-ray tube can not be used. Once the uncontrollable phenomenon occurs, the filament current can not be controlled, requiring the hot cathode exchange.

Inspecting the hot cathode which has become uncontrollable, the following cause was seen. Observing, with a microscope, the surface of the thermoelectronic emitter which is made of lanthanum hexaboride and has a plane size of 10 mm×0.5 mm and a thickness of 0.3 mm, several cracks were found. It was found also that all of the several hot cathodes which have become uncontrollable showed the similar cracks. Even when the particle size of the lanthanum hexaboride powder was changed, the tendency to cracks was unchanged although with a difference in degree. Of course, the hot cathode right after the sintering of the lanthanum hexaboride powder shows no crack. The thermoelectronic emitter is supposed to have random cracks after receiving any physical or thermal shock in the course of X-ray generation.

SUMMARY OF THE INVENTION

It is an object of the present invention to provide a hot cathode of an X-ray tube of the kind having thermoelectronic emitter supported by a heating element, in which no crack occurs on the thermoelectronic emitter.

Observing a certain hot cathode having cracks, several cracks were seen at intervals of several millimeters on a narrow thermoelectronic emitter. Then, further observing other several hot cathodes having cracks and measuring the distances between neighboring cracks, it has become clear that almost of the distances were more than three millimeters. Accordingly, we have produced an improved hot cathode in which a thermoelectronic emitter was divided into plural regions arranged in a straight line and the length of each region was less than three millimeters with the total length of the emitter being about ten millimeters, and then conducted a running experiment with X-ray generation. As a result, it was found that an uncontrollable phenomenon in filament current did not occur and the hot cathode taken out after the experiment showed no crack, which has been ascertained by observing with a microscope. On the basis of this experiment, the present invention has been developed in which the length of each emitter region is less than three millimeters and plural emitter regions are combined with each other to constitute a thermoelectronic emitter with a desired length so as to obtain a hot cathode with no danger of cracks.

Accordingly, the present invention provides a hot cathode of an X-ray tube of the kind having thermoelectronic emitter supported by a heating element, in which the thermoelectronic emitter is comprised of plural emitter regions separated from each other, each of the emitter regions having the largest measure less than three millimeters. The thermoelectronic emitter shows no crack and the filament current is stabilized.

It is noted that the "largest measure" of an emitter region stands for the largest value among all distances between any one point on the emitter region surface and any another point on the same emitter region surface. For a narrow emitter region, the largest measure is approximately the same as its length. For a circular emitter region, the largest measure is the same as its diameter. The present invention may be applied to not only narrow emitter regions but also emitter regions of any shapes. Even if the emitter regions have any shapes, no crack occurs as long as the largest measure is less than three millimeters.

DETAILED DESCRIPTION OF THE PREFERRED EMBODIMENTS

Figure 1:
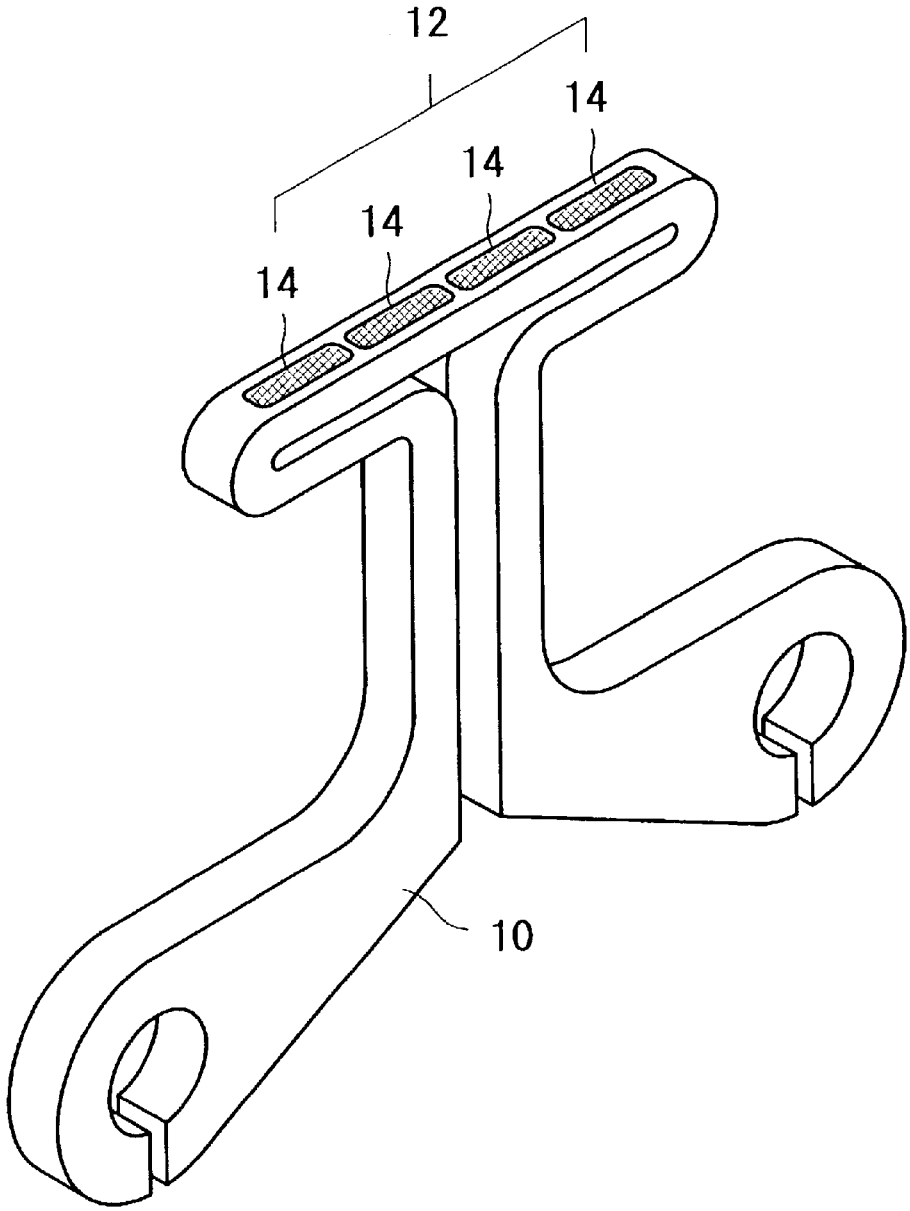
FIG. 1 is a perspective view illustrating a first embodiment of the present invention.

Referring to FIG. 1, a hot cathode is comprised of a heating element 10 made of glassy carbon and a thermoelectronic emitter 12 supported by the heating element 10. The thermoelectronic emitter 12 is comprised of plural emitter regions 14 each of which is made of sintered lanthanum hexaboride.

Figure 2A:
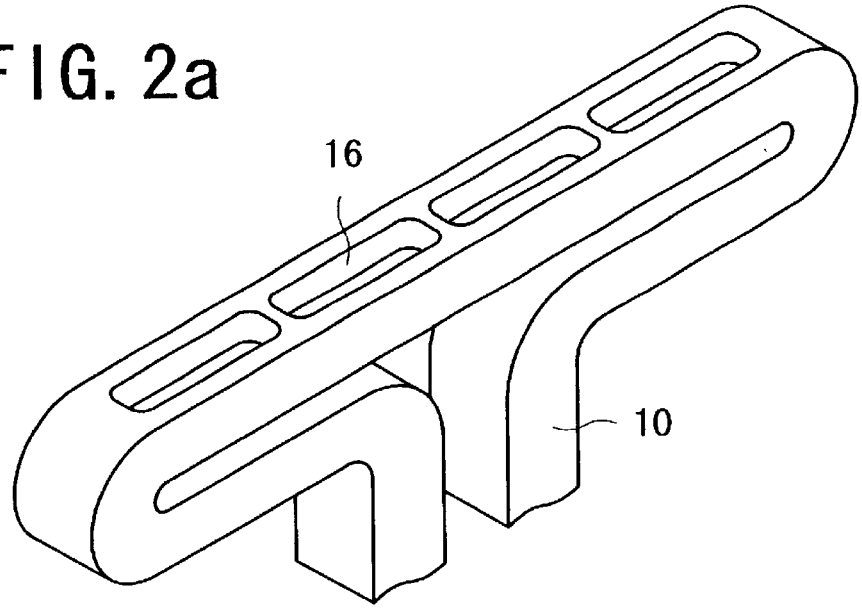
FIGS. 2*a* and 2*b* are enlarged perspective views each illustrating the neighborhood of a thermoelectronic emitter.
Figure 2B:
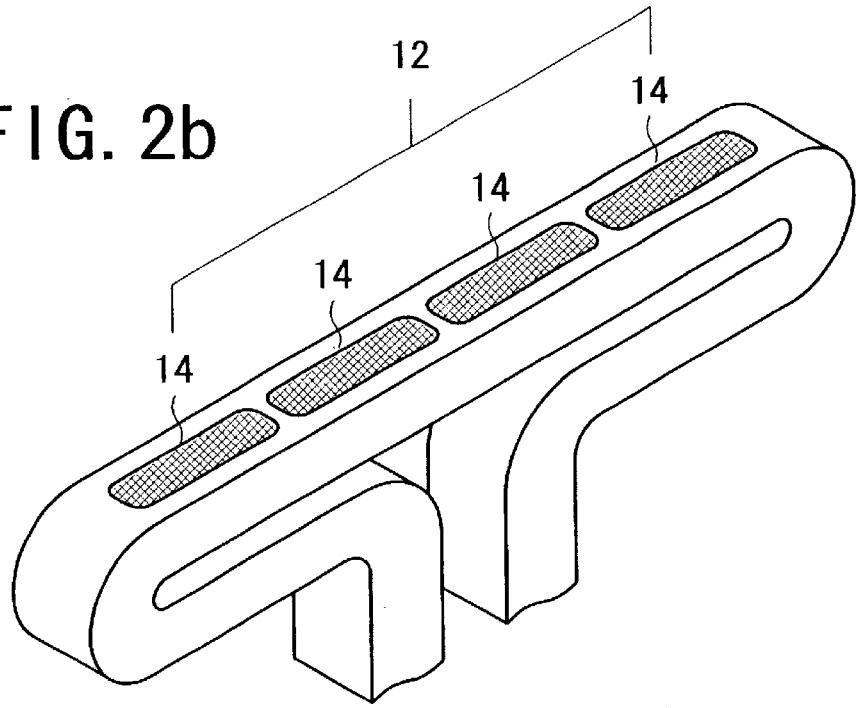

FIG. 2*a* shows the shape of a part of the heating element 10 before filling with lanthanum hexaboride powder, while FIG. 2*b* shows the same after filling with and sintering of the lanthanum hexaboride powder, i.e., the state of completion. Referring to FIG. 2*a*, the heating element 10 with a thickness of 1 mm is formed, at its thermoelectron-emitting side (i.e., a top side in the figure), with four recesses 16 each of which is 2.6 mm in length, 0.5 mm in width and 0.3 mm in depth. Thus, each recess 16 is surrounded by walls each having a height of 0.3 mm. The recess 16 has an approximately rectangular plane shape with a size of 2.6 mm×0.5 mm and with four rounded corners each of which has a radius less than 0.2 mm. These recesses 16 are arranged lengthwise in a straight line with 0.2 mm gaps therebetween.

Figure 4A:
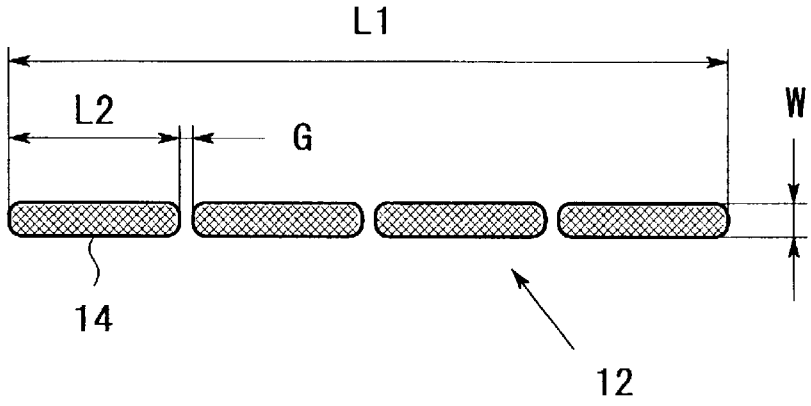
FIGS. 4*a* and 4*b* are plan views each showing plane measures of a thermoelectronic emitter.

The recesses 16 are filled with lanthanum hexaboride powder, which is then heated and sintered by supplying the heating element 10 with a current, so that four emitter regions 14 made of sintered lanthanum hexaboride are completed as shown in FIG. 2*b*. These four emitter regions 14 constitute as a whole a thermoelectronic emitter 12 which is 11 mm in length and 0.5 mm in width. FIG. 4*a* shows plane measures of the completed thermoelectronic emitter 12. The total length L1 is 11 mm and its width W is 0.5 mm. The length L2 of each emitter region 14 is 2.6 mm and its width W is 0.5 mm. The gap G between neighboring emitter regions 14 is 0.2 mm. The emitter region 14 has four rounded corners. The largest measure of each emitter region 14 is about 2.6 mm.

The following experiment was conducted on the hot cathode explained above. The hot cathode was mounted in an X-ray tube and run continuously for sixteen hours under the condition of 18 kV in tube voltage and 100 mA in tube current, and the stability was inspected. As a result, filament current hunting did not occur. Thereafter, the X-ray tube was opened and the surface of the hot cathode was observed with a microscope. Observing with a microscope with about twenty magnifications, no crack was seen on the emitter regions of the hot cathode. Next, a further experiment was conducted on the same hot cathode, which was further run for fourteen days under the condition of 40 kV–60 to 70 mA, and the stability was inspected. In the course of the fourteen-day experiment, the hot cathode was taken out several times and observed with a microscope, resulting in no crack observation. It was ascertained also that no filament current hunting occurred. As a result of the experiments, it is verified that the hot cathode of the present invention can be used with no danger of cracks and with higher stability as compared with the conventional hot cathode.

A stable filament current leads to a narrower control range because of no danger of hunting, so that the filament current can be controlled precisely and the output stability of the X-ray tube can be improved.

Next, the particle size of lanthanum hexaboride powder will be explained. The particle size of lanthanum hexaboride, with which the recesses are filled, would affect a cracking property. For example, if the particle sizes are standardized to about one micrometer, danger of cracks becomes higher. On the contrary, if various particle sizes are mixed (for example, within a range of several to twenty micrometers), danger of cracks becomes lower.

Figure 3A:
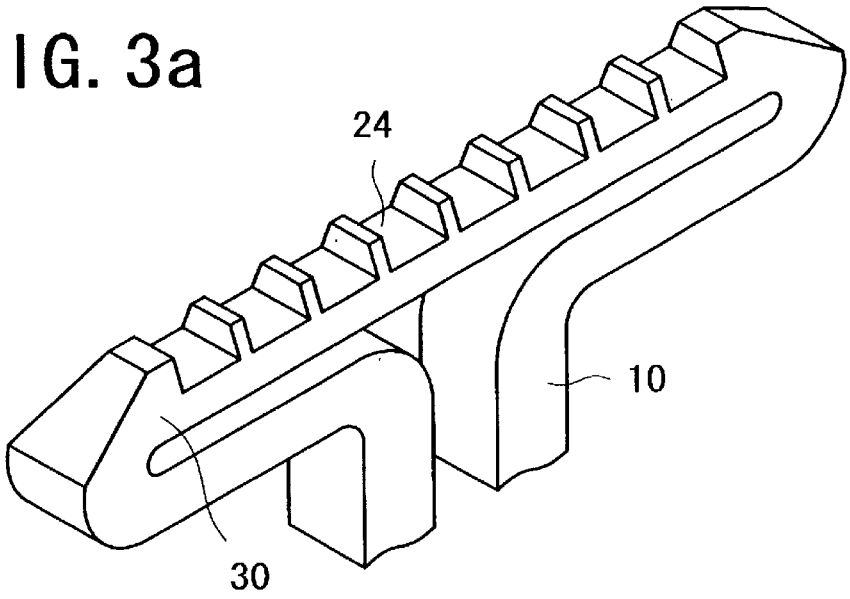
FIGS. 3*a* and 3*b* are enlarged perspective views, similar to FIGS. 2*a* and 2*b*, of the second embodiment of the present invention.
Figure 3B:
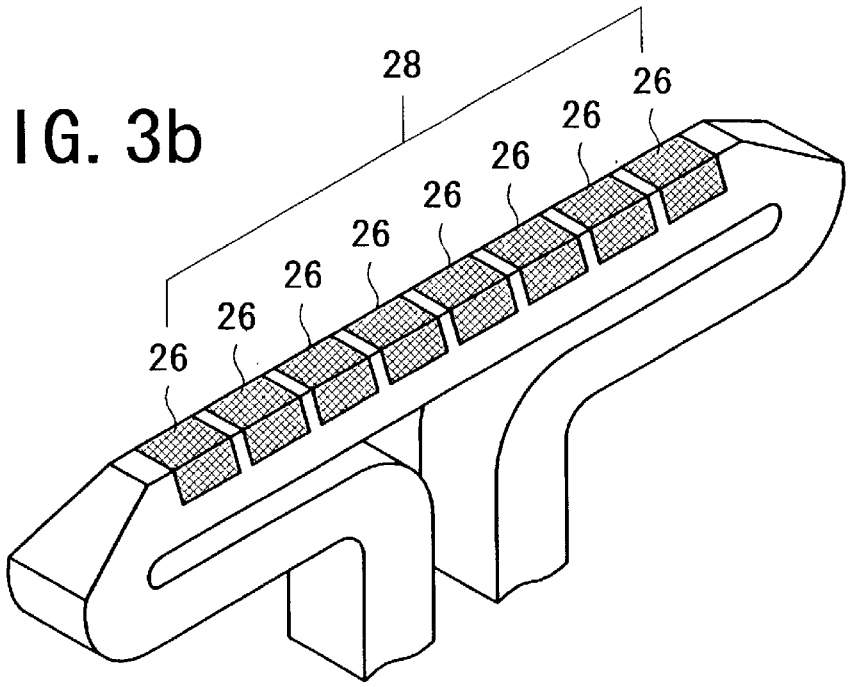

Next, the second embodiment of the present invention will be explained with reference to FIGS. 3*a* and 3*b*. FIG. 3*a* shows a part of a heating element 10 before filling with lanthanum hexaboride powder, while FIG. 3*b* shows the same after filling with and sintering of the lanthanum hexaboride powder. Referring to FIG. 3*a*, the heating element 10 is formed, at its thermoelectron-emitting side (i.e., a top side in the figure), with eight grooves (recesses) 24 each of which penetrates through the heating element 10 in a direction of the thickness of the heating element 10 and is 1.2 mm in length, 0.5 mm in width and 0.3 mm in depth. The heating element 10 with a thickness of 1 mm has a taper 30 whose thickness becomes thinner gradually as it approaches its tip, the thickness at its tip being 0.5 mm. Therefore, the width of the groove 24, i.e., the size in a direction of the thickness of the heating element 10, is 0.5 mm at the top and becomes wider gradually as it goes down. The plane shape of the groove 24 at the top of the heating element 10 is rectangular with a size of 1.2 mm×0.5 mm. These grooves 24 are arranged lengthwise in a straight line with 0.2 mm gaps therebetween.

Figure 4B:
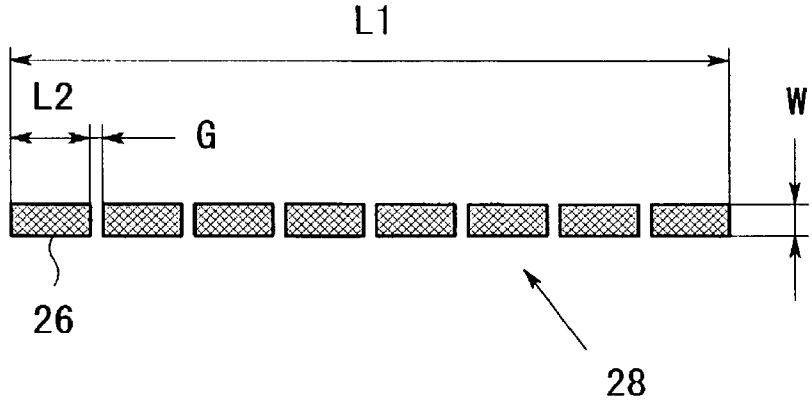

The grooves 24 are filled with lanthanum hexaboride powder, which is then heated and sintered by supplying the heating element 10 with a current, so that eight emitter regions 26 made of sintered lanthanum hexaboride are completed as shown in FIG. 3*b*. These eight emitter regions 26 constitute as a whole a thermoelectronic emitter 28 which is 11 mm in length and 0.5 mm in width. FIG. 4*b* shows plane measures at the top of the completed thermoelectronic emitter 28. The total length L1 is 11 mm and its width W is 0.5 mm. The length L2 of each emitter region 26 is 1.2 mm and its width W is 0.5 mm. The gap G between neighboring emitter regions 26 is 0.2 mm. The largest measure of each emitter region 26 is about 1.2 mm, noting that the largest measure is, strictly speaking, the diagonal length of the rectangle which is 1.3 mm.

In general, the hot cathode made of lanthanum hexaboride is applied much to an X-ray tube which can not use the conventional tungsten filament. Namely, the hot cathode made of lanthanum hexaboride would be effective in an X-ray analysis in which the characteristic X-rays of the tungsten filament would affect the analysis result, for example, in EXAFS measurement.

The material of the thermoelectronic emitter may be not only lanthanum hexaboride, which has been explained in the embodiments described above, but also $CeB_6$, ZrC or TiC.

What is claimed is:

1. A hot cathode of an X-ray tube of a kind having a thermoelectronic emitter supported by a heating element, wherein:

said thermoelectronic emitter is comprised of plural emitter regions separated from each other; and each of said emitter regions has a largest measure less than three millimeters.

2. A hot cathode according to claim 1, wherein:

each of said emitter regions has a narrow, approximately rectangular shape; and said emitter regions are arranged lengthwise in a straight line to constitute as a whole a narrow thermoelectronic emitter.

3. A hot cathode according to claim 1, wherein said heating element is made of glassy carbon.

4. A hot cathode according to claim 3, wherein said thermoelectronic emitter is made of sintered lanthanum hexaboride.

5. A hot cathode according to claim 1, wherein said thermoelectronic emitter is made of sintered lanthanum hexaboride.

6. A hot cathode according to claim 1, wherein said thermoelectronic emitter is made of any one of $CeB_6$, ZrC and TiC.

7. A method of producing a hot cathode of an X-ray tube of a kind having a thermoelectronic emitter supported by a heating element, comprises steps of:

(a) forming said heating element with plural recesses separated from each other, a largest plane measure of each of said recesses being less than three millimeters;

(b) filling said recesses with powder of material of said thermoelectronic emitter; and (c) supplying said heating element with a current to sinter said powder so as to complete said hot cathode of the kind having said thermoelectronic emitter supported by said heating element.

8. A method according to claim 7, wherein said material of said thermoelectronic emitter is lanthanum hexaboride powder.

9. A method according to claim 8, wherein said lanthanum hexaboride powder have various particle sizes which are mixed within a range of several to twenty micrometers.

10. A method according to claim 7, wherein each of said recesses has a narrow, approximately rectangular shape surrounded by walls, and said recesses are arranged lengthwise in a straight line.

11. A method according to claim 7, wherein:

said heating element has a taper whose thickness becomes thinner gradually;

said taper has a tip formed with plural recesses each penetrating through said heating element in a direction of a thickness of said heating element; and said recesses are arranged in a straight line.

* * * * *